US005268707A

United States Patent [19]

Katsuma et al.

[11] Patent Number: 5,268,707

[45] Date of Patent: Dec. 7, 1993

[54] DIRECT THERMAL PRINTER

[75] Inventors: Nobuo Katsuma; Hitoshi Saito, both of Tokyo, Japan

[73] Assignee: Fuji Photo Film Co., Ltd., Kanagawa, Japan

[21] Appl. No.: 924,914

[22] Filed: Aug. 5, 1992

[30] Foreign Application Priority Data

Aug. 5, 1991 [JP] Japan ..... 3-219224
Aug. 6, 1991 [JP] Japan ..... 3-221047

[51] Int. Cl.[5] ..... B41M 5/26; B41J 2/325

[52] U.S. Cl. ..... 346/76 R; 346/76 PH; 346/138

[58] Field of Search ..... 346/1.1, 76 R, 76 PH, 346/138; 430/146, 151, 348, 350, 351, 352

[56] References Cited

U.S. PATENT DOCUMENTS 4,734,704 3/1988 Mizutani et al. ..... 346/76 PH
4,962,386 10/1990 Hakkaku et al. ..... 346/1.1

FOREIGN PATENT DOCUMENTS 61-213169 9/1986 Japan .

*Primary Examiner*—Benjamin R. Fuller
*Assistant Examiner*—Huan Tran

[57] ABSTRACT

A direct thermal printer wherein a leading edge of a sheet of thermosensitive recording paper is clamped by a clamp member for securing the recording paper to a platen drum. After thermally recording an image and optically fixing the image on the recording paper, the recording paper is released from the clamp member to be ejected from the printer. When the leading edge of the recording paper, which has been under the clamp member and has therefore not yet been optically fixed, reaches an illuminating position of an ultraviolet lamp of an optical fixing device during the paper ejection, the lamp is turned on for a time period, so as to optically fix the leading end. The ultraviolet lamp is of a U-shape for reducing the optical fixing time.

14 Claims, 8 Drawing Sheets

DIRECT THERMAL PRINTER

BACKGROUND OF THE INVENTION

1. Field of the Invention

The present invention relates to a direct thermal printer, and more particularly to a direct thermal printer wherein the whole portion of a thermosensitive color recording medium is optically fixed. The present invention also relates to an optical fixing device for use in the direct thermal printer.

2. Related Art

There are generally two types of thermal printers: one type is for direct thermal recording using thermosensitive recording media and the other type is for thermal transfer recording including wax thermal transfer recording and thermal dye transfer recording. The direct thermal printers print images directly on thermosensitive recording media, so that no waste, such as a dye transfer sheet, is produced. Furthermore, the construction of the direct thermal printer is simpler and thus the running cost of the direct thermal printer is lower than that of the thermal transfer printer.

Because of these preferable features, the direct thermal printers tend to be used more frequently. For example, most facsimile transmitters are provided with monochromatic direct thermal printers. Recently, a thermosensitive color recording medium, has been suggested, for example, in Japanese Laid-open Patent Application 61-213169, which has, for example, three thermosensitive coloring layers for developing magenta, cyan and yellow colors formed on one another, so that full-color images can be recorded thereon by using direct thermal printers.

In the thermosensitive color recording medium, thermal recording is sequentially performed from the upper or outer most coloring layer to the lower or inner most coloring layer. After recording each of the coloring layers, electromagnetic rays having a wave length range which is specific to each coloring layer are projected onto the recording medium, for optically fixing the just-recorded coloring layer, so that the coloring layer is not repeatedly recorded during the following thermal recording process.

For example, when the yellow recording layer is disposed at the outermost of the coloring layers, and the second layer disposed under the yellow recording layer is the magenta recording layer, the yellow recording layer contains a diazonium salt compound which is optically decomposed by near ultraviolet rays having a wave length of about 420 nm, while the magenta recording layer contains a diazonium salt compound which is optically discomposed by ultraviolet rays having a wave length of about 365 nm. Thereby, the yellow recording layer is optically fixed by using the near ultraviolet rays of about 420 nm before thermal recording the magenta recording layer, and the magenta recording layer is optically fixed by using the ultraviolet rays of about 365 nm.

Because of the diazonium salt compounds, the thermosensitive recording medium is colored yellow. After being optically fixed, because the diazonium salt compounds have been discomposed, the thermosensitive recording medium becomes white.

Meanwhile, it is known in the thermal printer to use a clamp member for holding the recording medium, such as a sheet of thermosensitive color recording paper, onto a supporting material, such as a platen drum. The clamp member presses a portion of the thermosensitive color recording paper, mostly, the leading edge thereof, so as to prevent the thermosensitive color recording paper from slipping out from the platen drum while being rotated.

Because the portion pressed by the clamp member is not exposed to the electromagnetic rays for optical fixing, there has been a problem that the portion of the thermosensitive color recording paper remains yellow even after the completion of the recording and fixing processes.

On the other hand, it is conventional to use a linear lamp having a circular section for optical fixing. The linear lamp is disposed downstream of a thermal head in a direction parallel to a rotary shaft of the platen drum. However, the conventional linear lamp is inconvenient for exchange, because sockets for attaching the linear lamp are mounted to a pair of frames for supporting the rotary shaft of the platen drum. Accordingly, it is necessary to open a casing of the thermal printer when exchanging the lamp.

SUMMARY OF THE INVENTION

In view of the foregoing, a primary object of the invention is to provide a direct thermal printer, and a method of direct thermal recording, wherein the whole portion of the thermosensitive recording medium is optically fixed so that a yellow portion does not remain on the recording medium.

Another object of the invention is to provide an optical fixing device for a direct thermal printer wherein lamp exchange can be easily carried out.

To achieve the above and other objects and advantages, the present invention provides a detecting device and a control device. The detecting device outputs a detection signal when a clamping portion of the thermosensitive recording medium such as a thermosensitive color recording paper, at which the clamp member has clamped the recording paper during thermal recording and optical fixing, is released from the clamp member and placed in an illuminating position of the optical fixing device. The control device actuates the optical fixing device, upon receipt of the detection signal, to project the electromagnetic rays onto the clamping portion of the recording paper, so as to optically fix the clamping portion.

As a result, it is possible to optically fix the whole portion of the thermosensitive recording medium, so that a yellow portion does not remain in the recording medium after completing the recording.

According to a preferred embodiment of the present invention, a supporting member for supporting the recording paper thereon, such as a platen drum, is stopped during the optical fixing of the clamping portion.

According to another preferred embodiment of the invention, the ejection speed of the recording paper is decelerated during the optical fixing of the clamping portion.

The optical fixing device preferably includes at least a U-shaped ultraviolet lamp. Thereby, it becomes possible to easily exchange the ultraviolet lamp, without the need for opening the casing of the thermal printer to a large extent.

BRIEF DESCRIPTION OF THE DRAWINGS

Other objects and advantages of the present invention will become apparent in the following detailed description of the preferred embodiments when read in connection with the accompanying drawings, wherein like reference numerals designates like or corresponding parts throughout the several views, and wherein.

DETAILED DESCRIPTION OF THE PREFERRED EMBODIMENTS

Figure 1:
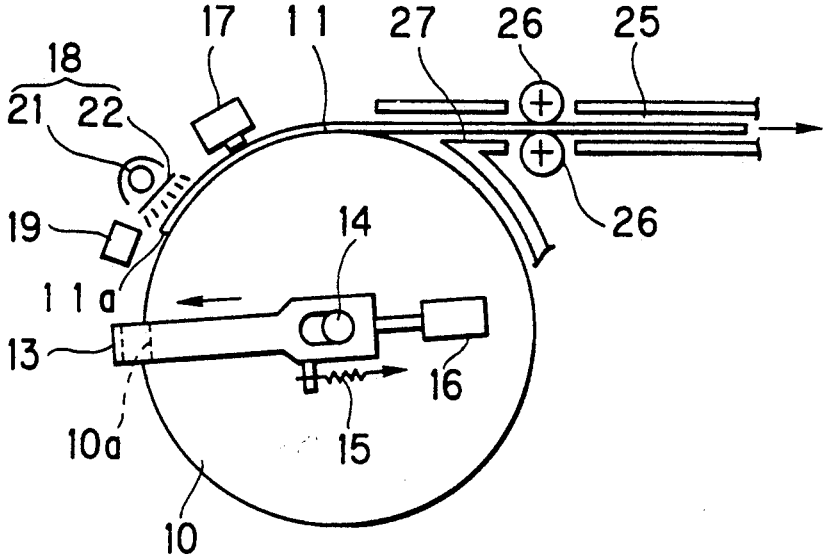
FIG. 1 schematically shows a direct thermal printer according to an embodiment of the present invention, in a state where the leading edge of a thermosensitive recording paper, which has been clamped by a clamp member, is optically fixed.
Figure 2:
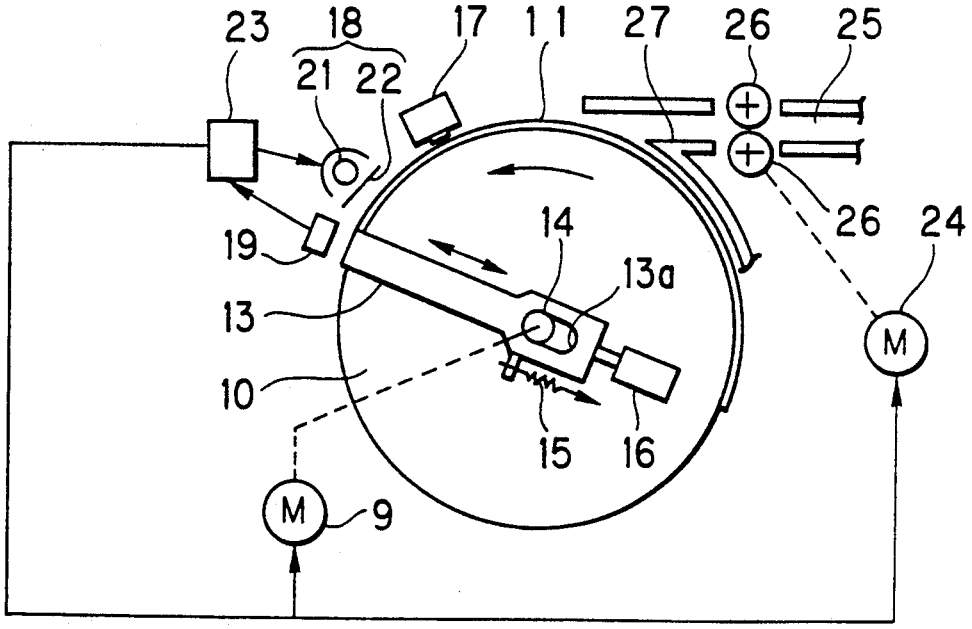
FIG. 2 schematically shows the direct thermal printer in a state where thermal recording and optical fixing are carried out.

In FIGS. 1 and 2, a platen drum 10 carries a thermosensitive color recording paper on the outer periphery thereof, and is rotated by a pulse motor 9, during thermal recording and optical fixing. The platen drum 10 is provided with a clamp member 13 which secures the thermosensitive color recording paper 11 to the platen drum 10 at least at a portion, for example, of the leading end 11*a* of the paper 11 by pressing the leading end portion 11*a* into a groove 10*a* formed on the platen drum 10.

The clamp member 13 is movably engaged with a rotary shaft 14 of the platen drum 10 through slots 13*a* at each end of the rotary shaft 14, and is urged by a spring 15 to fit into the groove 10*a*. When clamping the paper 11, and when releasing the paper 11, the clamp member 13 is moved away from the groove 10*a* by an act of a solenoid 16.

Above the outer periphery of the platen drum 10, a thermal head 17 is disposed to form a thermal recording station, and an optical fixing device 18 is disposed downstream of the thermal recording station. Furthermore, a sensor 19 is disposed near the downstream portion of the optical fixing device 18. The thermal head 17 has a plurality of heating elements conventionally arranged in a line. The heating elements each individually radiate a variable amount of heat energy corresponding to the density of the pixel to be recorded, and depending on the color of the pixel.

Figure 3:
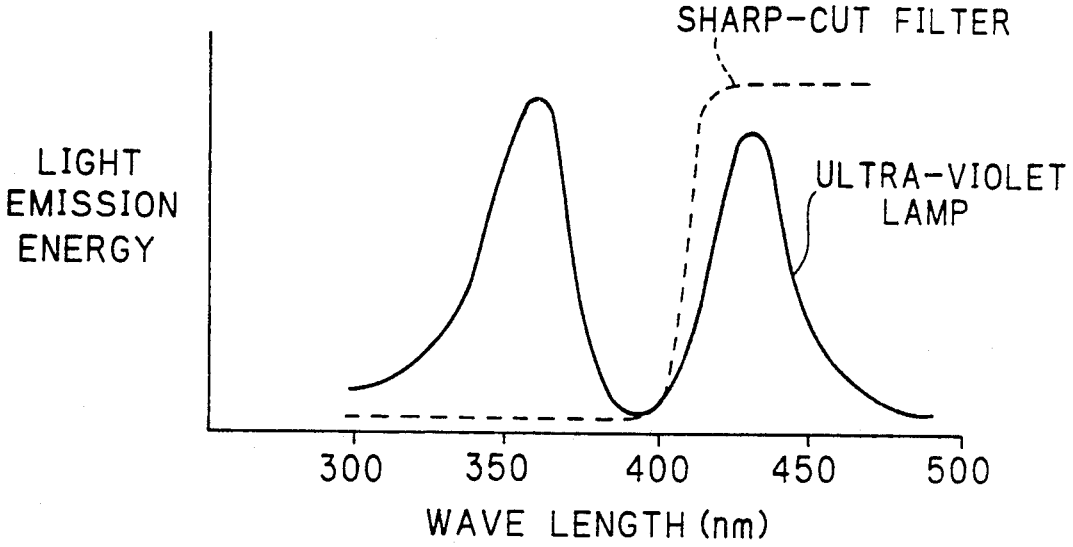
FIG. 3 is a graph showing characteristic curves of an ultraviolet lamp and a sharp-cut filter which are used in an optical fixing device.

The optical fixing device 18 includes an ultraviolet lamp 21 having two emission center wavelengths of about 365 nm and 420 nm, as shown by a solid line curve in FIG. 3, and a sharp-cut filter 22 having a transmission curve as shown by a dashed line in FIG. 3. The sharp-cut filter 22 is placed on the front of the ultraviolet lamp 21 by a solenoid or another driving device, so as to transmit near ultraviolet rays having a wave length range of only about 420 nm.

A paper feed path 25 is provided with a pair of feed rollers 26 which are driven by a motor 24, and through which the paper 11 is transported. Downstream of the paper feed path 25, that is, on the side near to the platen drum 10, a separation claw 27 is provided for peeling off the trailing edge of the paper 11 from the platen drum 10 and guiding the paper 11 to the paper feed path 25 when ejecting the paper 11. In this embodiment, the paper feed path 25 is commonly used for paper feeding and ejecting. Of course, it is possible to provide a paper ejection path separately from a paper feed path.

The sensor 19 outputs a detection signal to the controller 23 when the sensor 19 detects that the leading edge 11*a* has been removed from the clamp member 13 during ejection of the thermosensitive color recording paper 11. Upon receipt of the detection signal, the controller 23 stops the motor 24 so as to interrupt the paper ejection and, at the same time, turns the ultraviolet lamp 21 on so as to project the ultraviolet rays onto the leading edge 11*a*, for optically fixing the leading edge 11*a*. The controller 23 performs this operation according to a sequence shown in FIG. 4.

Figure 5:
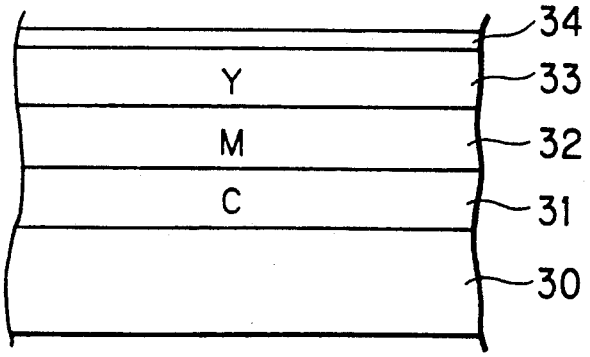
FIG. 5 schematically shows the construction of a thermosensitive color recording medium.

FIG. 5 shown an example of the thermosensitive color recording medium, wherein a cyan recording layer 31, a magenta recording layer 32 and a yellow recording layer 33 are formed on a supporting material 30 in this order from the bottom. The order of the coloring layers 31 to 33 depends on the order of thermal recording of these coloring layers 31 to 33. Therefore, it is possible to change the position of these coloring layers. For example, if the magenta recording layer 32 is to be recorded first, and the yellow recording layer 33 is to be recorded next, then the positions of the magenta recording layer 32 and the yellow recording layer 33 are exchanged.

The supporting material 30 is an opaque coated paper or a plastic film. However, when an OHP (over-head projector) sheet is desired to be made, a transparent plastic film is used as the supporting material 30.

The cyan recording layer 31 contains an electron donating dye precursor and an electron accepting compound as main components, and is colored in cyan when a predetermined amount of heat energy per unit area is applied thereto. The magenta recording layer 32 contains a diazonium salt compound having a maximum absorption factor at a wave length of about 360 nm and a coupler which acts upon the diazonium salt compound and is developed in magenta when it is heated. The magenta recording layer 32 loses its capacity of color-developing when it is exposed to ultraviolet rays of about 360 nm, because the diazonium salt compound is photochemically decomposed by this range of electromagnetic rays. The yellow recording layer 33 contains a second diazonium salt compound having a maximum absorption factor at a wave length of about 420 nm and a coupler which acts upon the second diazonium salt compound and is colored in yellow when it is heated. The yellow recording layer 33 also loses its color developability when it is exposed to near ultraviolet rays of about 420 nm.

Because the magenta and yellow recording layers 32 and 33 contain the diazonium salt compound, the thermosensitive color recording medium 11 is initially yellow-colored. After the magenta and yellow recording layer 32 and 33 are optically fixed, the recording medium 11 becomes white.

Figure 6:
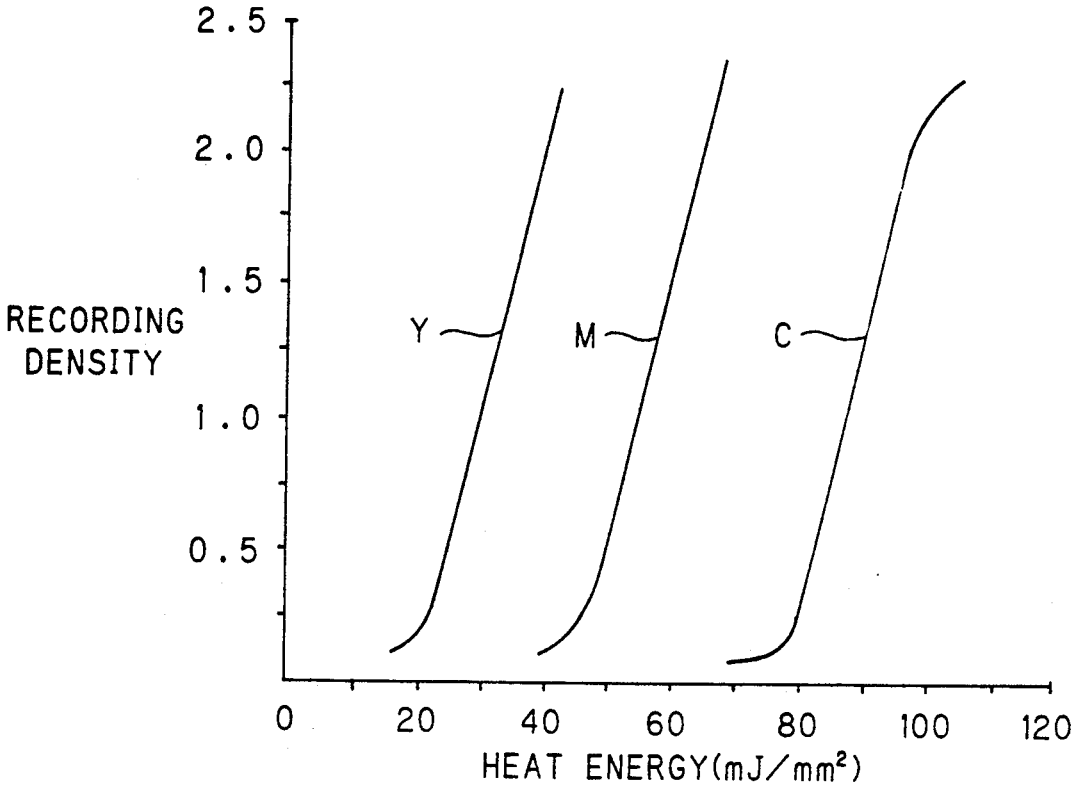
FIG. 6 is a graph showing the coloring characteristics of the thermosensitive color recording medium.

FIG. 6 illustrates the respective characteristic curves of the thermosensitive coloring layers 31 to 33. The horizontal axis indicates the amount of heat energy per unit area radiated by the heat element of the thermal head 17. The heat energy necessary for color-developing in the yellow recording layer 33 is the lowest, while the heat energy for the cyan recording layer 31 is the highest. This is mainly because heat energy reaches the cyan recording layer 31 after being transmitted through the yellow and magentarecording layers 33 and 32.

Figure 4:
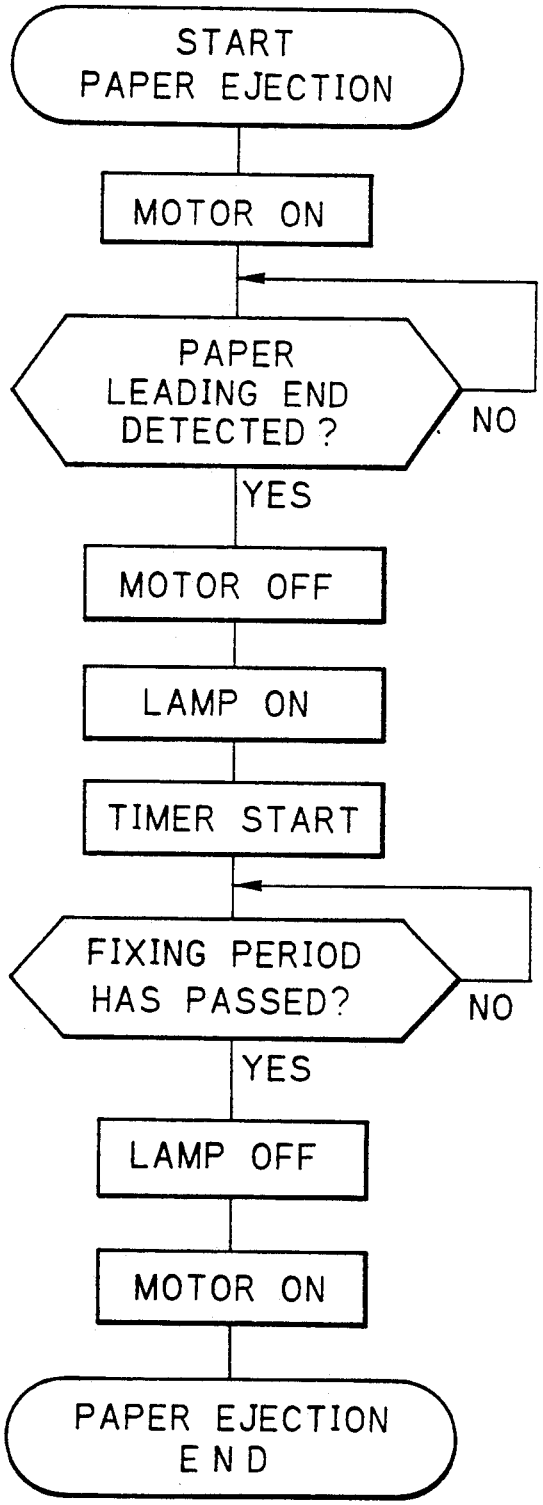
FIG. 4 is a flow chart illustrating a paper ejection sequence corresponding to the embodiment of FIG. 1.

Next, the operation of the above-described direct color thermal printer will be described with reference to FIG. 4.

When the paper is being fed, the platen drum 10 stays in a situation where the clamp member 13 is placed at the exit f the paper feed path 25 with its arm portions oriented vertically as shown in FIG. 1. The solenoid 16 is energized to remove the clamp member 13 from the groove 10*a*. The pair of feed rollers 26 nip and feed their thermosensitive color recording paper 11 toward the platen drum 10. The feed rollers 26 stop rotating when the leading edge of the thermosensitive color recording paper 11 is placed in the groove 10*a*. Thereafter, the solenoid 16 is turned off, so that the clamp member 13 is moved back into the groove 10*a* according to the force of the spring 15. As a result, the thermosensitive color recording paper 11 is clamped by the clamp member 13. After clamping the thermosensitive color recording paper 11, the platen drum 10 and the feed rollers 26 start rotating, so that the thermosensitive color recording paper 11 is wound on the outer periphery of the platen drum 10.

When a leading edge of a recording area of the thermosensitive color recording paper 11 reaches the thermal head 17, the recording of a yellow frame of the full-color image is started. During the yellow frame recording, each heat element of the thermal head 17 is heated to a temperature that is determined in consideration of the recording characteristics shown in FIG. 6. The part of the thermosensitive color recording paper 11 on which the yellow frame is recorded is moved to the optical fixing device 18 and is optically fixed. Because the sharp-cut filter 22 is placed in front of the ultraviolet lamp 12 at that time, near ultraviolet rays of about 420 nm are projected onto the thermosensitive color recording paper 11. Thereby, the diazonium salt compounds contained in the yellow recording paper 33 are decomposed to lose its color-developability, except for those diazonium salt compounds existing in the leading edge 11*a*.

When the platen drum 10 makes one revolution to place the recording area under the thermal head 17, a magenta frame of the full-color image begins to be recorded line by line in the magenta recording layer 32. During thermal recording of the magenta frame, the sharp-cut filter 22 is retracted from the front of the ultraviolet lamp 21, so that all of the ranges of the electromagnetic rays from the ultraviolet lamp 21 are projected onto the thermosensitive color recording paper 11. The magenta recording layer 32 is optically fixed by ultraviolet rays of about 365 nm from the electromagnetic rays.

After optical fixing of the yellow and magenta recording layers 33 and 32, the thermosensitive color recording paper 11 becomes white except for the leading edge 11*a*. It is to be noted that because the heat energy per unit area required for color-developing in the magenta recording layer 31 is controlled within a range from about 40 to 70 $mJ/mm^2$ in accordance with the desired recording density of each magenta pixel, as is shown in FIG. 6. Although this heat energy range for the magenta recording layer 32 is higher than that required for color-developing in the yellow recording layer 33, because the yellow recording layer 33 has already been optically fixed, the yellow recording layer 33 will neither react nor effect color-developing.

The platen drum 10 makes one further revolution, and the thermal head 17 starts recording a cyan frame of the full-color image line by line in the cyan recording layer. Because the heat energy per unit area required for color-developing in the cyan recording layer 31 is about 80 $mJ/mm^2$ or more, the cyan recording layer 31 will not be color-developed under a normal reserving condition. Therefore, the optical fixing device 18 is turned off during thermal recording of the cyan frame, and thus the optical fixing process of the cyan recording layer 31 is omitted.

After recording the yellow, magenta and cyan frames of the full-color image, the platen drum 10 and the feed rollers 26 are rotated in a reverse direction. Thereby, the trailing edge of the thermosensitive color recording paper 11 is guided by the separation claw 27 into the paper feed path 25, and this trailing edge is nipped by the feed rollers 26. Then, the solenoid 16 is energized and, simultaneously, the platen drum 10 is stopped. When the solenoid 16 is energized, the clamp member 13 is moved away from the platen drum 10 against the force of the spring 15, so that the leading edge 11*a* of the thermosensitive color recording paper 11 is released from the clamp member 13.

After releasing the clamping condition, the motor 24 is rotated to start ejecting the thermosensitive color recording paper 11. During the paper ejection, the controller 23 stops driving the motor 24 after a predetermined delay time from the time when the sensor 19 detects the leading edge 11*a*. The delay time is determined in consideration of the distance from the sensor 19 to the optical fixing device 18. Thereby, the leading edge 11*a* stops in an illuminating position of the optical fixing device 18, as shown in FIG. 1. Simultaneously, the ultraviolet lamp 21 of the optical fixing device 18 is turned on while the sharp-cut filter 22 is displaced from the front of the ultraviolet lamp 21. A timer included in the controller 23 starts running simultaneously with the turning-on of the ultraviolet lamp 21, so as to clock a given fixing time period which is necessary for optically fixing the leading edge 11*a*. When optically fixed, the leading end 11*a* becomes white. When the given fixing time period has elapsed, the ultraviolet lamp 21 is turned off, and the motor 24 is again rotated to eject the thermosensitive color recording paper 11 from the thermal printer through the paper feed path 25.

Figure 7:
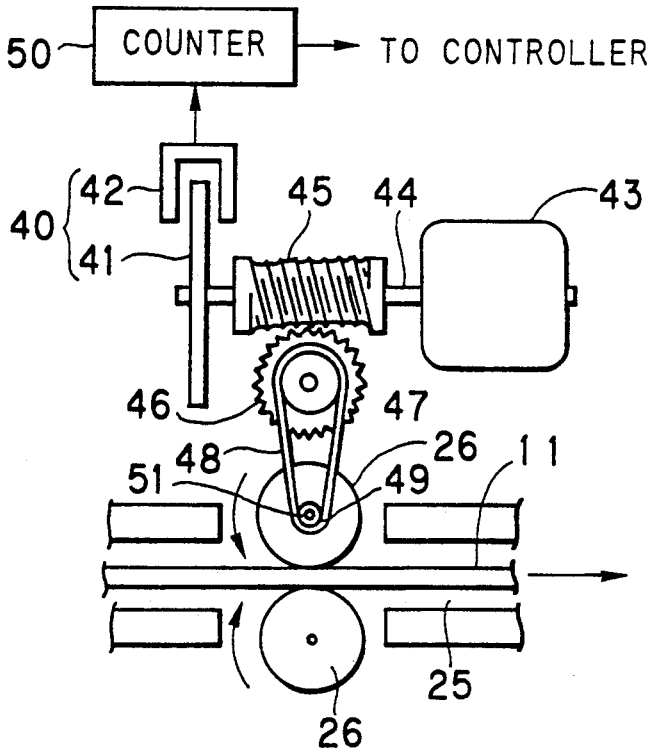
FIG. 7 shows essential parts of a direct thermal printer according to another embodiment of the present invention, where the paper ejection speed is decelerated during the optical fixing of the clamping portion of the thermosensitive recording paper.
Figure 8:
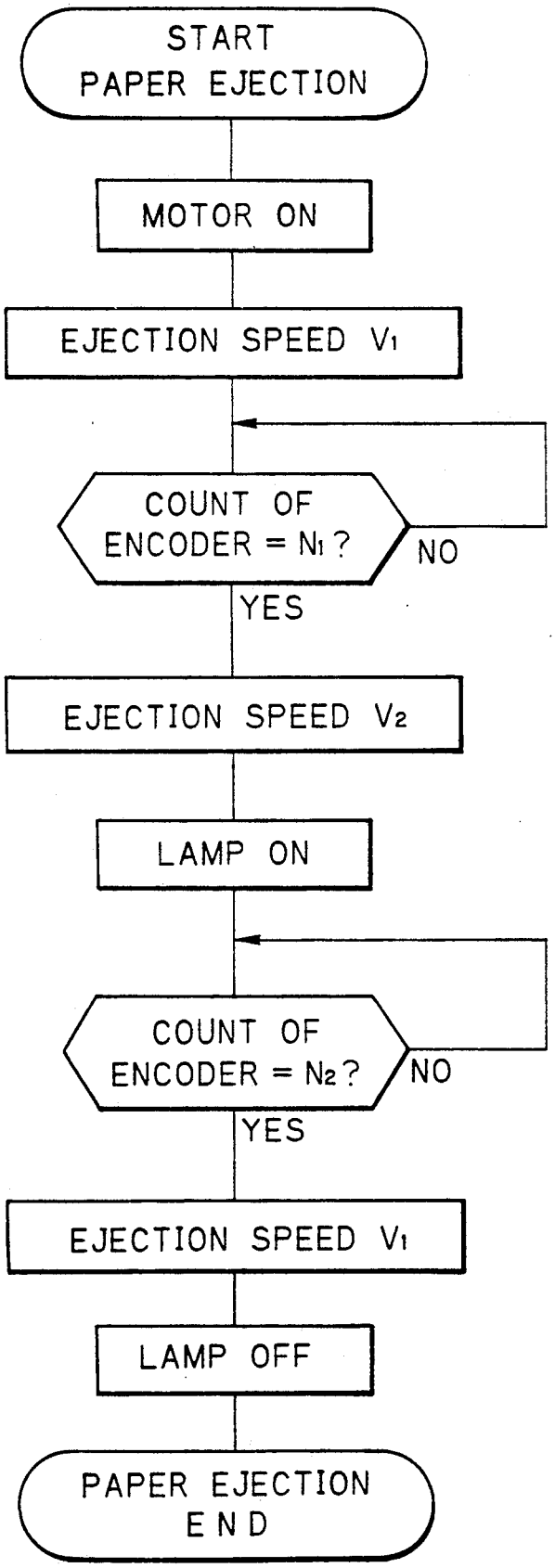
FIG. 8 is a flow chart illustrating a paper ejection sequence corresponding to the embodiment of FIG. 7.

Referring to FIGS. 7 and 8, another embodiment of the invention will be described. In this embodiment, a rotary encoder 40 is disposed in a drive mechanism of the feed rollers 26, in place of the sensor 19, for detecting a timing at which the leading edge 11*a* reaches the illuminating position of the optical fixing device 18 during the paper ejection of the thermosensitive color recording paper 11. The rotaryencoder 40 includes a rotary disc 41 with slits which extend radially and are spaced from each other at regular intervals on the disc 41, and a sensor unit 42. The sensor unit 42 has a light emitting element and a light receiving element which are disposed on the opposite sides of the rotary disc 41. The rotary disc 41 is secured to a drive shaft 44 of a motor 43 which is controlled by the controller 23. While the rotary disc 41 is rotated, the sensor unit 42 outputs a pulse signal to the counter 50. The rotational movement of the drive shaft 44 is transmitted to an axle 51 of the pair of the feed rollers 26 through a worm wheel 45, a spur gear 46, a first pulley 47, a belt 48 and a second pulley 49.

As illustrated in FIG. 8, the thermosensitive color recording paper 11 is transported at a high speed V1 at the beginning of the paper ejection. Directly after the thermosensitive color recording paper 11 is nipped between the feed rollers 26, the counter 50 starts counting the number of pulses of the pulse signal from the sensor unit 42, so as to detect the rotational amount of the drive shaft 44. Because the distance between the illuminating position of the optical fixing device 18 and the feed rollers 26 and the length of a sheet of the thermosensitive color recording paper 11 are constant and known, it is possible to determine a count value N1 of the counter 50 at the timing at which the leading 11*a* reaches the illuminating position.

Accordingly, when the count of the counter 50 reaches N1, the speed of the motor 43 is decelerated so as to change over the ejection speed of the thermosensitive color recording paper to a low level V2 which is suitable for optical fixing. Simultaneously, the ultraviolet lamp 21 of the optical fixing device 18 is turned on. When the counter 50 further counts up to a count N2, which means that the leading edge 11*a* has passed through the illuminating position, the motor 43 is accelerated to change over the ejection speed again to the high level V1 and, simultaneously, the ultraviolet lamp 21 is turned off. In this way, the thermosensitive color recording paper 11 is ejected from the direct thermal printer at the high speed V1 after the whole portion of the sheet of the thermosensitive color recording paper 11 including the leading edge 11*a* is optically fixed.

Figure 9:
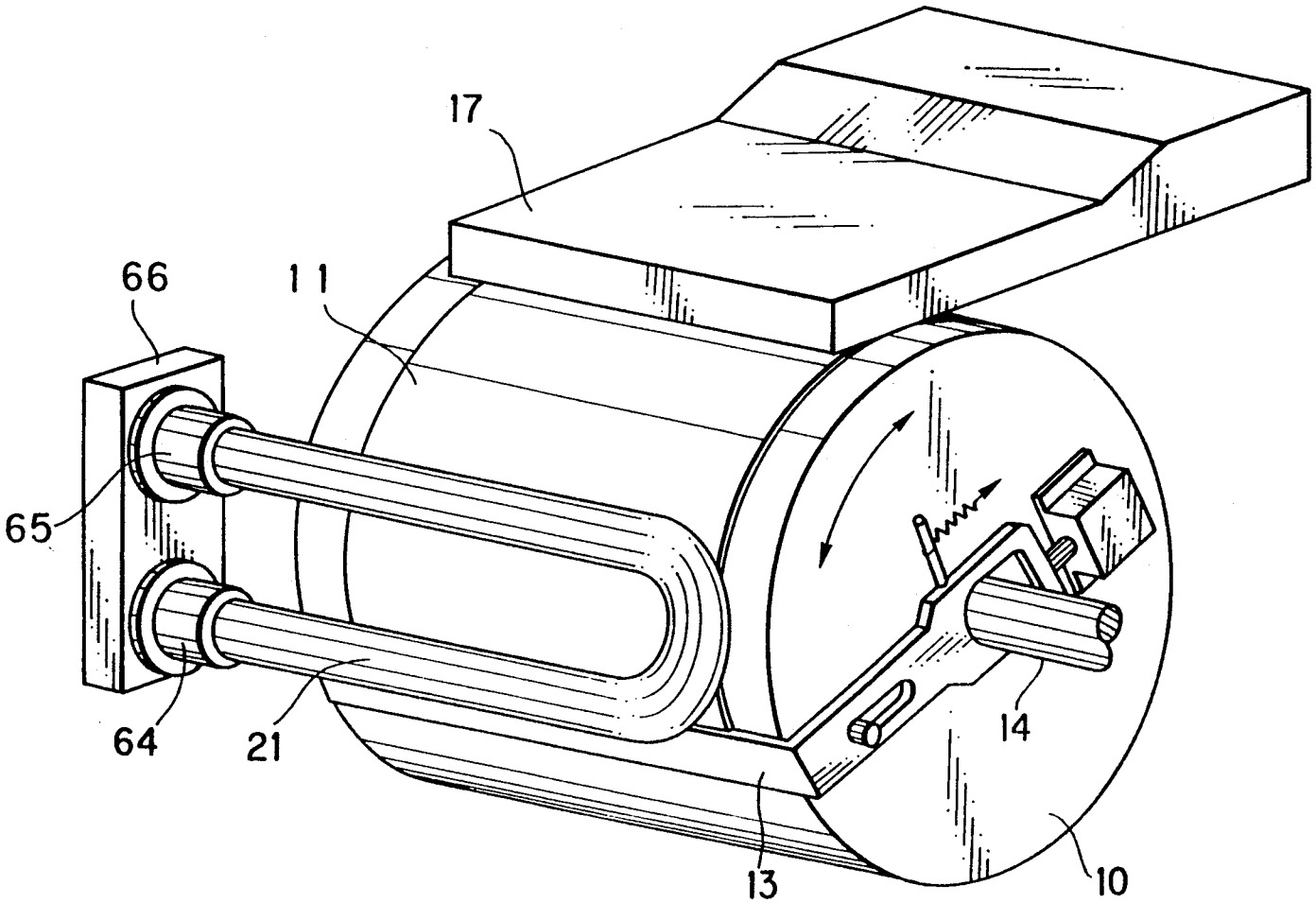
FIG. 9 is a perspective view showing an embodiment of the optical fixing device in connection with the platen drum and the thermal head.
Figure 10:
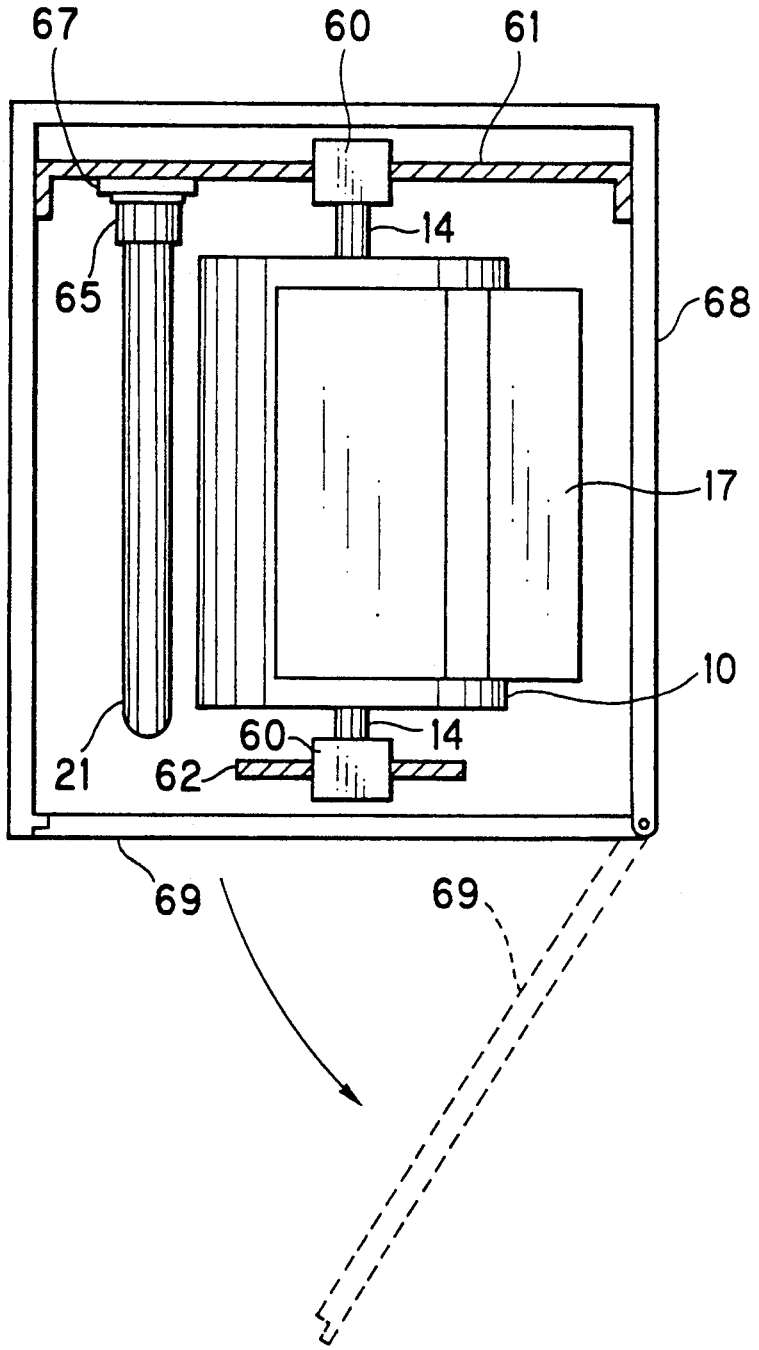
FIG. 10 is a schematic plane view of the direct thermal printer, viewed from the thermal head side, with a top cover plate broken away for clarity.
Figure 11:
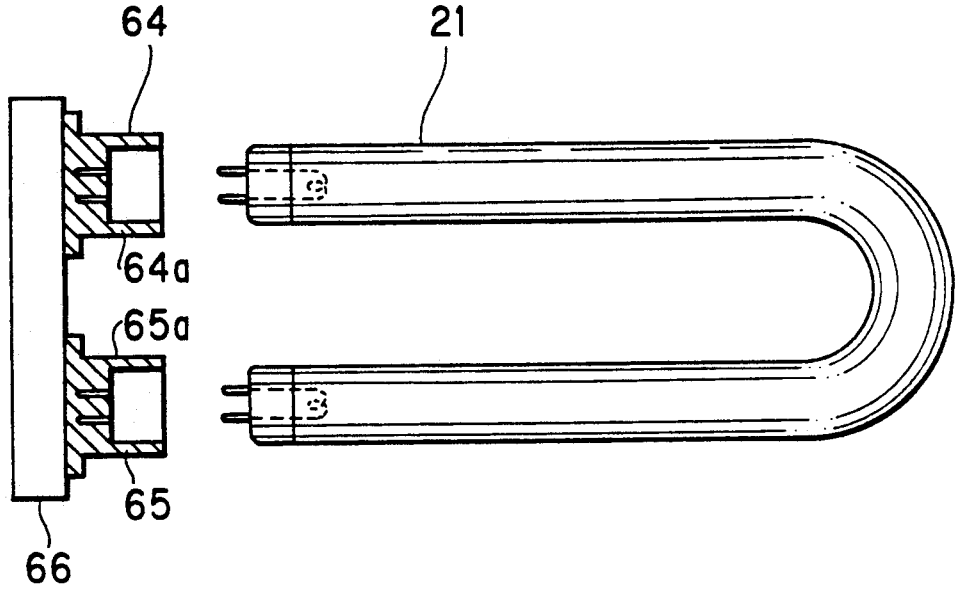
FIG. 11 is a plane view, and a partial cross section view, of a U-shaped lamp and sockets of the optical fixing device.

FIGS. 9 to 11 show an embodiment of the ultraviolet lamp 21 of the optical fixing device 18, where the drive shaft 14 of the platen drum 10 is rotatably mounted to frames 61 and 62 through a pair of bearings 60. The ultraviolet lamp 21 is of a U-shape, and sockets 64 and 65 for supporting the ultraviolet lamp 21 are mounted to the frame 61 through a base plate 66. The sockets 64 and 65 have guide portions 64*a* and 65*a* respectively, for guiding and holding the ultraviolet lamp 21 in a proper situation.

The frame 61, which is disposed in the rear of the platen drum 10, is secured to the inner wall of a casing 68 of the direct thermal printer. The other frame 62, which is disposed in the front of the platen drum 10, is shorter than the rear frame 61 in a horizontal direction, so as not to interfere the exchange of the ultraviolet lamp 21. In particular, there are spacings on the right and left sides of the front frame 62. The casing 68 has a front panel 69, which may be opened, and a top cover plate (not shown).

When exchanging the ultraviolet lamp 21, the front panel 69 is opened after disconnecting the direct thermal printer from a power source. The ultraviolet lamp 21 is removed from the sockets 64 and 65 by being pulled in a straight and forward direction of the casing 68. At that time, because of the spacing between the casing wall and the front frame 62, it is easy to access the ultraviolet lamp 21. A new ultraviolet lamp is inserted through the spacing between the casing wall and the front frame 62 toward the rear frame 61, with its electrodes in the lead. Thereby, the electrodes of the new ultraviolet lamp are fitted into the sockets 64 and 65, which completes the lamp exchange.

Figure 12:
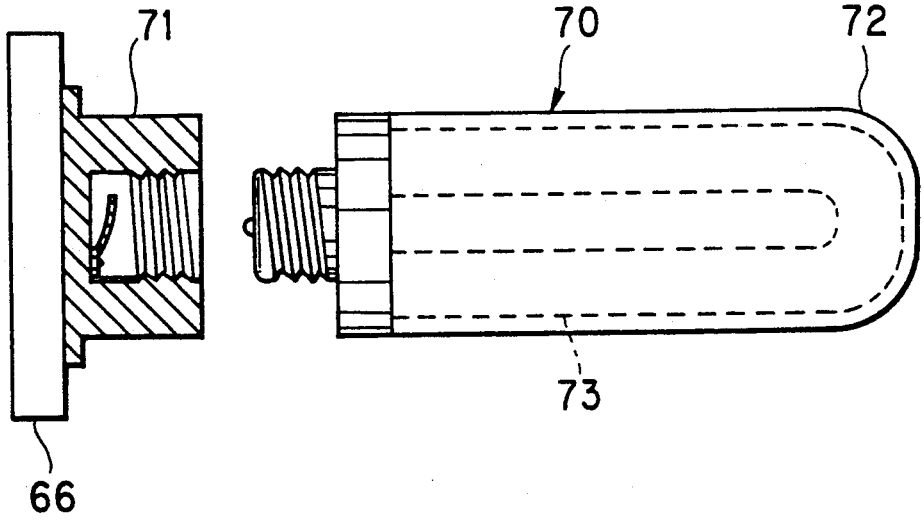
FIG. 12 is a plane view, and a partial cross section view, of a screw socket type U-shaped lamp of the optical fixing device.

Although the ultraviolet lamp 21 shown in FIGS. 9 to 11 is connected through a pair of sockets 64 and 65, it is possible to use an ultraviolet lamp 70 which is adapted to be connected through a screw socket 71, as shown in FIG. 12. In this modification, a U-shaped lamp body 73 is covered with a cylindrical cover 72 which is, for example, made of a transparent heat resilient resin material. However, the cylindrical cover 72 is not always necessary. Moreover, it is possible to use a W-shaped lamp or the like which has at least two U-shaped lamps arranged in succession as a unit.

The U-shaped lamp for the optical fixing device makes it easy to pull out the lamp and connect the same for the lamp exchange. Furthermore, because the total length of the U-shaped lamp is doubled as compared with a conventional linear lamp extending over the same length, the emission area of the lamp is increased, so that the fixing time period can be greatly reduced.

Although the above-described embodiment only relates to a color direct thermal printer, the invention may be applied to a monochromatic direct thermal printer.

It is possible to use two optical fixing devices in the color direct thermal printer, which radiate electromagnetic rays having wave lengths of 420 nm and 365 nm for optical fixing yellow and magenta recording layers, respectively.

It is also possible to use a conveyer belt or a sliding table instead of the platen drum, to which a clamp member is attached. The thermosensitive color recording paper may be clamped at the trailing end.

Furthermore, the invention is applicable to serial printers wherein pixels are serially printed by a two-dimensional movement of the recording medium relative to the thermal head, although the above embodiments only relate to line printers wherein the recording medium is moved linearly relative to the thermal head.

Thus, the invention is not intended to be limited by the above-described embodiments but, on the contrary, various modifications of the invention can be effected without departing from the spirit and scope of the appended claims.

What is claimed is:

1. A direct thermal printer comprising:

a supporting member for supporting a thermosensitive recording medium thereon;

a clamp member for securing said thermosensitive recording medium to said supporting member;

a thermal head for thermally recording an image on said thermosensitive recording medium;

an optical fixing device for optically fixing said thermosensitive recording medium by projecting electromagnetic rays onto said thermosensitive recording medium;

detecting means for outputting a detection signal when a clamping portion of said thermosensitive recording medium, at which said thermosensitive recording medium has been clamped by said clamp member during thermal recording and optical fixing, is released from said clamp member and placed in an illuminating position of said optical fixing device; and control means for actuating said optical fixing device, responsive to said detection signal, to project the electromagnetic rays onto said clamping portion of said thermosensitive recording medium, so as to optically fix said clamping portion.

2. A direct thermal printer as recited in claim 1, wherein said supporting member includes a platen drum driven by a motor to move said thermosensitive recording medium relative to said thermal head and said optical fixing device.

3. A direct thermal printer as recited in claim 2, wherein said optical fixing device includes an ultraviolet lamp disposed in an outer periphery of said platen drum and extending in a direction of an axis of said platen drum.

4. A direct thermal printer as recited in claim 3, wherein said detecting means comprises a sensor disposed at a position upstream of said ultraviolet lamp in a direction to eject said thermosensitive recording medium from said direct thermal printer.

5. A direct thermal printer as recited in claim 4, wherein said clamping portion is a leading edge of a sheet of said thermosensitive recording medium, and said sensor outputs said detection signal when said sensor detects the leading edge while said thermosensitive recording medium is ejected in a rearward direction.

6. A direct thermal printer as recited in claim 5, wherein said control means controls said motor so as to stop rotating said platen drum for a predetermined time period, during the optical fixing of said clamping portion.

7. A direct thermal printer as recited in claim 6, wherein said ultraviolet lamp is of a U-shape.

8. A direct thermal printer as recited in claim 3, wherein said detecting means comprises a rotary encoder and a transporting device disposed in an ejection path for transporting said thermosensitive recording medium through said ejection path, and a counter for counting a number of pulses outputted from said rotary encoder.

9. A direct thermal printer as recited in claim 8, wherein said rotary encoder detects a transported amount of said thermosensitive recording medium based on a rotational amount of rollers of said transporting device, and said counter detects a timing at which said clamping portion of said thermosensitive recording medium reaches said illuminating position of said ultraviolet lamp based on the transported amount of said thermosensitive recording medium and a predetermined distance between said illuminating position and said rollers.

10. A direct thermal printer as recited in claim 9, wherein said control means also controls said rollers so as to transport said thermosensitive recording medium at a lower speed than a predetermined ejection speed, during the optical fixing of said clamping portion of said thermosensitive recording medium.

11. A direct thermal printer as recited in claim 10, wherein said ultraviolet lamp is of a U-shape.

12. A method of controlling a direct thermal printer having a thermal head, an optical fixing device, a supporting member for supporting a thermosensitive recording medium thereon, said supporting member being movable relative to said thermal head and said optical fixing device, and a clamp member for securing said thermosensitive recording medium to said supporting member, said method comprising the steps of:

(a) releasing a clamping portion of said thermosensitive recording medium, which has been clamped by said clamp member, from said clamp member;

(b) transporting thereafter said thermosensitive recording medium toward an exit path of said direct thermal printer;

(c) detecting when said clamping portion reaches an illuminating position of said optical fixing device during said step (b);

(d) projecting electromagnetic rays onto said clamping portion of said thermosensitive recording medium, when said clamping portion is placed in said illuminating position, for optically fixing said clamping portion; and (e) ejecting thereafter said thermosensitive recording medium from said exit path.

13. A method as recited in claim 12, further comprising the step of (f) stopping the transport of said thermosensitive recording medium during said step (d), for a predetermined time period which is necessary for optically fixing said clamping portion.

14. A method as recited in claim 13, further comprising the step of (g) decelerating the speed of transporting said thermosensitive recording medium during said step (d), to a level sufficient for optically fixing said clamping portion.

* * * * *